United States Patent [19]

Granovksy

[11] Patent Number: 4,833,571

[45] Date of Patent: May 23, 1989

[54] FOLDING SOLAR REFLECTOR PANEL AND ASSEMBLY

[76] Inventor: Vladimir Granovksy, 726 Malcolm Ave., Los Angeles, Calif. 90024

[21] Appl. No.: 156,163

[22] Filed: Feb. 16, 1988

[51] Int. Cl.[4] ..... F21V 7/00

[52] U.S. Cl. ..... 362/16; 362/346; 362/320; 350/613

[58] Field of Search ..... 362/1, 3, 7, 16, 17, 362/18, 319, 320, 346; 350/607, 611, 612, 613

[56] References Cited

U.S. PATENT DOCUMENTS

| | | | |
|---|---|---|---|
| 890,651 | 6/1908 | Holm | 350/613 |
| 2,124,146 | 7/1938 | Miller | 350/613 |
| 3,254,207 | 5/1966 | Lowell | 350/613 |
| 3,851,164 | 11/1974 | Intrator | 362/7 |
| 4,050,790 | 9/1977 | Jorwa | 362/346 |
| 4,388,675 | 6/1983 | Lewin | 362/346 |
| 4,428,030 | 1/1984 | Baliozian | 362/320 |
| 4,460,946 | 7/1984 | Tinsz | 362/16 |
| 4,524,405 | 6/1985 | Heard | 362/320 |
| 4,669,033 | 5/1987 | Lee | 362/319 |

*Primary Examiner*—Ira S. Lazarus
*Assistant Examiner*—D. M. Cox
*Attorney, Agent, or Firm*—Erik M. Arnhem

[57] ABSTRACT

The reflector panel includes a unitary structure comprised of longitudinal sections of corrugated paper or cardboard having one reflecting side and folding lines to allow folding for compact portability.

2 Claims, 1 Drawing Sheet

FOLDING SOLAR REFLECTOR PANEL AND ASSEMBLY

BACKGROUND OF THE INVENTION (1) Field of the Invention

My invention is concerned with a folding reflector structure or panel.

More particularly, my invention is concerned with a foldable reflector panel and components to hold the panel in the extended position for reflection of light, for example, on a regular photographer's tripod, and means to hold the folded panel for compact storage. The panel is particularly useful for reflecting solar and light radiation in still and motion picture photography, as well as video-tape recording.

(2) Prior Art

The prior art includes U.S. Pat. Nos. 890,651 of S. Holm for a Photographic Reflector; 1,005,731 of W. C. Miles for an Oblique Folding Mirror; 1,099,820 of G. T. Ridings for a Combined Camera Support and Posing Device; 2,827,553 of E. S. Riches for a Photographic Lighting Apparatus; 3,254,207 of R. Lowell for a Reflecting Device; 3,583,793 of H. C. Crisogono et al for a Sun Beacon; 4,245,895 of K. Wildenrotter for a Supporting Structure for Reflectors, Solar Cells or Solar Cell Carriers; and 4,501,469 of V. Merges et al for a Mirror Structure for Reflecting and Concentrating Radiation Energy.

SUMMARY OF THE INVENTION

In accordance with one aspect of my invention, there is provided a folding light reflector, for reflecting solar and light radiation in photography, motion picture and video-tape recording, comprising: a panel adapted to be folded for portability and extended for reflection of solar and light radiation in a substantially planar condition to present at least one surface for reflection in said unfolded or extended condition, said panel having a plurality of folding lines to allow unfolding to the extended condition and folding of said panel for compact portability and storage.

In accordance with one embodiment, the .panel is made of reinforced corrugated paper or the like material.

In accordance with a further embodiment, the panel has a central aperture for mounting said panel on a photographer's tripod, an easel, or the like support means.

It may also be preferred that at the panel folding and/or score lines are provided alternatingly on the first, forward, side and the second, rearward, side thereof.

In general terms, the light reflector panel has affixed on the reflecting side a vinyl silver laminate.

The components can be manufactured of polyurethane/polypropylene.

In accordance with another aspect of my invention, there is provided a light reflector panel for use in reflecting solar and light radiation in photography, motion picture and video recording, said panel being adapted to be folded and unfolded along the respective folding lines to present a substantially planar surface for reflection of light when in the unfolded or extended condition, and to present a compact portable unit when in the folded condition upon folding along the folding lines.

Thus, the folding light reflector panel has a plurality of sections respectively connected in pairs at a common folding line and forming a unitary panel structure as aforesaid.

The panel has a first side and a second side which extends co-planar with respect to the first side or surface, and further has lateral edges, particularly two horizontal, first, edges and two vertical, second, edges; with the folding lines extending parallel in the direction of the horizontal or first edges.

The reflector or reflector panel has a light reflecting foil secured at the first side thereof and each section of the panel can be folded along a respective folding line to be in contact with the adjacent panel section, in congruent and compact superposition for portability of the unit after use.

For its use, the reflector is such that each section of the panel can be aligned or extended into a flat structure with respect to an adjacent section at the respective folding line to present said panel in the planar condition for reflection of light radiation.

The panel is comprised of longitudinal sections, i.e., the panel sections have a length which is greater than the width when considered in plan view.

In accordance with another aspect of my invention, there is provided a kit including: a panel as aforesaid; at least one pair of matching u-channel bars, or u-shaped slide bars or channel members, for retaining the panel in its extended, unfolded, condition by being mounted on the edges extending perpendicularly with respect to the folding lines.

The kit also includes at least one pair of lock clips for retaining the panel in the folded condition.

The kit further includes at least one threaded fastener for securing the panel to a photographer's tripod and the like support.

Included in the objects of my invention are:

To provide a reflecting panel for use in photography, motion picture and video-tape recording which reflector is of economical design.

To provide a reflector apparatus which is easily assembled for use outdoors and indoors.

To provide a reflector kit which is easily yet effectively stored.

DESCRIPTION OF THE DRAWING

The foregoing and other objects, features and advantages will become apparent from the following description, reference being made to the accompanying drawing in which.

SPECIFIC DESCRIPTION

Figure 1:
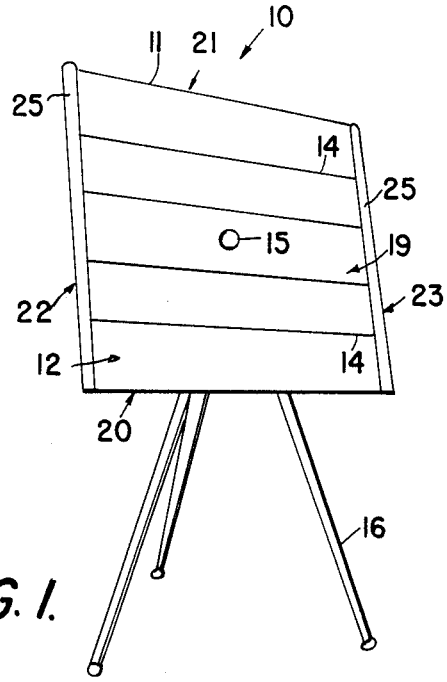
FIG. 1 is a perspective view showing the light reflector panel in the unfolded or extended condition, mounted on a photographer's tripod.
Figure 2:
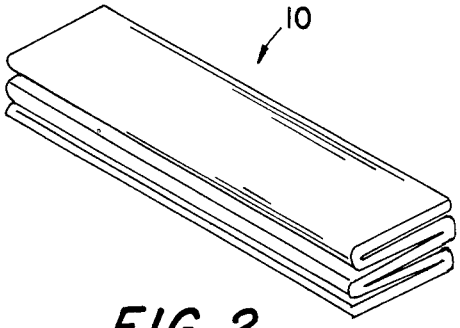
FIG. 2 is a perspective view of the reflector in the folded or compact condition.
Figure 3:
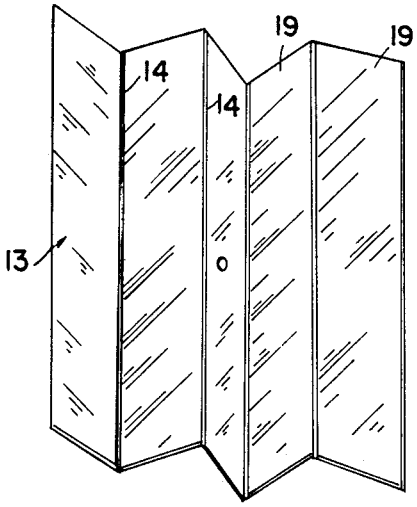
FIG. 3 is a perspective view of the rearward side of the reflector showing the reflector being folded for storage.
Figure 4:
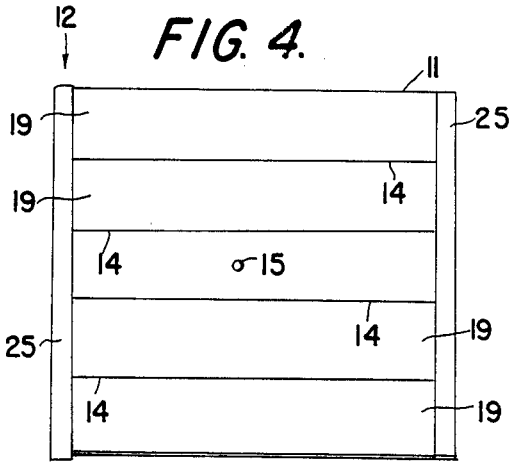
FIG. 4 is a plan view showing the reflector panel in the unfolded or extended condition for use.

My light reflector, generally identified by reference numeral 10 is particularly intended for use in reflecting solar and light radiation for still photography, motion picture and video-tape recording. It can be used in all other circumstances wherein a concentration or enhancement of light is required.

The reflector 10 includes a panel 11 which is adapted to be folded for portability and extended for reflection of solar and light radiation in a substantially planar condition to present at least one substantially planar surface 12 for reflection in said unfolded or extended condition.

Thus, the panel 11 has at least one reflecting surface or side 12, and a rearward side 13. The panel 11 has a plurality of folding lines 14 and can be folded in concertina fashion along the predetermined folding lines 14 for compact portability.

The panel 11 is made of reinforced corrugated paper, or a similarly rigid and strong material, but with sufficient pliability to allow folding along the predetermined folding lines 14.

The panel 11 has a central aperture 15 for mounting it on a photographer's tripod, and the like support. The tripod is generally identified by reference numeral 16.

The light reflecting surface or side 12 has affixed to it a light-reflecting laminate 19.

My light reflector panel 11 for use in reflecting solar and light radiation in still photography, motion picture and videotape recording, is adapted to be folded and unfolded along the folding lines 14 to present a substantially planar surface or side 12 for reflection of light when in the unfolded condition, and to present a compact portable unit when in the folded condition upon folding at the folding lines 14.

The light reflector panel 11 is comprised of a plurality of section 19 connected at respective folding lines 14 and thus forms a unitary panel structure, with said first side 12 and said second side 13 extending in co-planar manner with respect to each other. The panel 11 has lateral edges, namely two horizontal first edges 20 and 21, respectively, as well as two vertical, second edges 22 and 23, respectively.

Each section 19 of the panel 11 can be folded along a respective folding line 14 to be in contact with the adjacent panel section 19 in congruent and compact superposition for portability of the unit.

Equally, each panel section 19 can be aligned with the respective adjacent panel section 19 at the respective folding line 14 to present the panel 11 in the planar condition for reflection of light radiation as aforesaid.

The invention also includes a kit comprised of one panel 11, at least one pair of matching u-channel bars or u-channel slide bars 25 for reinforcing the unfolded panel 11 and for retaining the panel 11 in the unfolded condition by being mounted on the edges 22 and 23 extending perpendicularly with respect to the folding lines 14.

Figure 5:
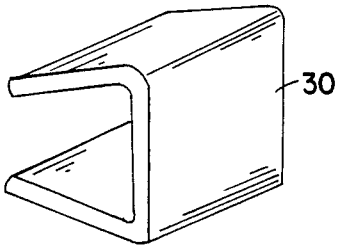
FIG. 5 is a perspective view of a lock-clip for keeping the panel in the folded condition.
Figure 6:
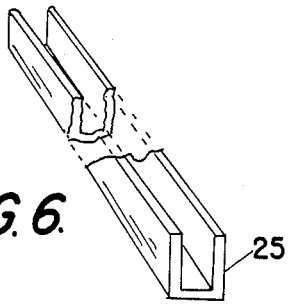
FIG. 6 is a perspective view of the u-channel bar for retaining the panel in the unfolded condition.
Figure 7:
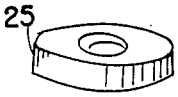
FIG. 7 is a perspective view of the wheel nut for securing the panel on a photographer's support.
Figure 8:
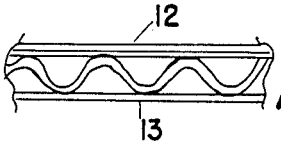
FIG. 8 is a cross section taken transversely through the panel.

The kit also includes at least one pair of lock clips 30 (FIG. 5) for retaining the panel 11 in the folded condition. There is also included in the kit at least one threaded fastener or wheel nut 35 for securing the panel 11 on a photographer's tripod (16), or the like stand.

Thus, my compact solar and light reflector can be used for still and motion photography, as well as in video-tape recording.

It increases light conditions in daylight photography and helps to prevent underexposure by means of reflecting sunlight and/or other light on the subject. The reflector functions by diverting the existing light to areas not reached by the respective radiation or rays, and so enables normal exposure in shadow and dark corner locations. My reflector provides all the functions of a regular solar reflector, used in the photo/motion picture/television industry—and it is truly compact, lightweight and portable.

The obverse side or face 12 of the panel 11 is providing softer light reflection at close range, e.g., desired for portrait situations.

It is made of reinforced corrugated paper, for example, and presents a concertina-type oblong unit which unfolds into a square panel with a silver laminate surface.

The reflector can be mounted on any standard photo tripod, and it is thus capable of providing the power of sunlight at different angles. It will also perform when hand-held or supported by any suitable object.

The reflector can also be a real life-saver in deserts, wilderness and mountain areas or on water. Because the reflected sunlight can be spotted over many miles, it could prove to be the only way of attracting attention to someone in an emergency situation. Even if land, sea or air rescue is in progress, it is mostly very difficult to detect a minor object from a distance. To attract attention, the reflected sunlight is directed to the point from where help could be expected.

The kit is equipped with five components made of plastic, for example, polyurethane/polypropylene, or PVC:

two u-channel slide bars for fixing the unit in a stretched or planar position;

two lock clips for keeping the folded unit from opening.

It will be understood that the embodiments illustrated in the aforesaid are primarily used for describing the present invention, but not as limiting the present invention. Any structure or apparatus made with or without minor modification s but not deviating from the spirit, concept and features of the present invention is deemed as being included in the scope of the claims of my invention.

I claim:

1. A light reflector panel comprised of longitudinal sections, for use in reflecting solar and light radiation in still and motion picture photography and video-tape recording, said panel being adapted to be folded and unfolded along folding lines to present a substantially planar surface for reflection of light when in the unfolded condition, and to present a compact portable unit when in the folded condition upon folding at said folding lines; said light reflector panel comprising:

a plurality of section, respectively connected at an associated folding line and forming a unitary panel structure, said panel having a first side and a second side co-planar with respect to said side and lateral edges, two horizontal, first, edges and two vertical, second, edges; and a light reflecting foil secured at said first side;

wherein each section of said panel can be aligned with the respective adjacent section at the respective folding line to present said panel in the planar condition for reflection of light radiation as aforesaid; and wherein each section of said panel can be folded along a respective folding line to be in contact with the adjacent panel section in congruent and compact superposition for portability, at least one pair of matching u-channel slide bars for reinforcing the unfolded panel and for retaining said panel in the unfolded condition by a respective u-channel slide bar being mounted on each edge extending perpendicularly with respect to the folding lines, at least one pair of clips for retaining the panel at the short sides thereof when in the folded condition; and at least one threaded fastener for securing said panel to a photographer's tripod and the like stand.

2. The light reflector panel of claim 1 wherein said threaded fastener is a wheel nut.

* * * * *